US009503807B2

(12) United States Patent
Murphy

(10) Patent No.: US 9,503,807 B2
(45) Date of Patent: Nov. 22, 2016

(54) ACOUSTIC HORN ARRANGEMENT

(75) Inventor: David John Murphy, Henley Beach (AU)

(73) Assignee: Krix Loudspeakers Pty Ltd., Hackham (AU)

( * ) Notice: Subject to any disclaimer, the term of this patent is extended or adjusted under 35 U.S.C. 154(b) by 149 days.

(21) Appl. No.: 14/127,383

(22) PCT Filed: Jun. 22, 2012

(86) PCT No.: PCT/AU2012/000733
§ 371 (c)(1),
(2), (4) Date: Feb. 14, 2014

(87) PCT Pub. No.: WO2012/174611
PCT Pub. Date: Dec. 27, 2012

(65) Prior Publication Data

US 2014/0185854 A1 Jul. 3, 2014

(30) Foreign Application Priority Data

Jun. 22, 2011 (AU) ..... 2011902439

(51) Int. Cl.
*H04R 1/28* (2006.01)
*G10K 11/02* (2006.01)
*H04R 1/26* (2006.01)
(Continued)

(52) U.S. Cl.
CPC ..... *H04R 1/2865* (2013.01); *G10K 11/02* (2013.01); *G10K 11/025* (2013.01); *H04R 1/26* (2013.01); *H04R 1/30* (2013.01); *H04R 1/24* (2013.01); *H04R 2201/34* (2013.01)

(58) Field of Classification Search
CPC .... G10K 11/025; G10K 11/28; G10K 11/02; H04R 1/34; H04R 1/345; H04R 1/32; H04R 1/30; H04R 1/2865; H04R 1/26; H04R 1/24; H04R 2201/34
USPC ..... 381/339, 340, 337; 181/152, 155, 159, 181/175, 177, 192
See application file for complete search history.

(56) References Cited

U.S. PATENT DOCUMENTS 4,308,932 A 1/1982 Keele, Jr.
5,526,456 A * 6/1996 Heinz ..... H04R 1/26 181/152
6,038,326 A * 3/2000 Czerwinski ..... H04R 1/26 181/152

(Continued)

FOREIGN PATENT DOCUMENTS

DE 102008057315 A1 * 5/2010 ..... H04R 1/24

OTHER PUBLICATIONS

International Search Report for corresponding PCT Application No. PCT/AU2012/000733, dated Dec. 2, 2012 (6 pgs.).

(Continued)

*Primary Examiner* — Davetta W Goins
*Assistant Examiner* — Oyesola C Ojo
(74) *Attorney, Agent, or Firm* — Shumaker & Sieffert, P.A.

(57) ABSTRACT

An acoustic horn arrangement including an acoustic horn, a first sound driver operable to drive the acoustic horn and a second sound driver further operable to drive the acoustic horn. The acoustic horn arrangement also including an interface region where sound from the second sound driver transfers into the acoustic horn to combine with sound from the first sound driver, wherein the interface region is adapted to reduce changes in a beam angle measure of the acoustic horn as a function of frequency.

19 Claims, 20 Drawing Sheets

(51) Int. Cl.
*H04R 1/30* (2006.01)
*H04R 1/24* (2006.01)

(56) References Cited

U.S. PATENT DOCUMENTS 6,118,883 A * 9/2000 Rocha ..... H04R 1/24 181/144
6,411,718 B1 6/2002 Danley et al.
7,134,523 B2 * 11/2006 Engebretson ..... H04R 1/26 181/144
8,824,718 B2 * 9/2014 Held ..... G10K 9/00 381/337
2004/0005069 A1 * 1/2004 Buck ..... H04R 1/30 381/336
2010/0278368 A1 * 11/2010 Martin ..... H04R 1/30 381/340

OTHER PUBLICATIONS

Written Opinion for corresponding PCT Application No. PCT/AU2012/000733, dated Sep. 17, 2012 (6 pgs.).
Murphy et al., "Modelling Acoustic Horns with FEA," Audio Engineering Society (AES) 128th Convention, London, United Kingdom, Paper No. 8076, May 2010 (11 pgs.).

* cited by examiner

ACOUSTIC HORN ARRANGEMENT

PRIORITY DOCUMENTS

The present application claims priority from Australian Provisional Patent Application No. 2011902439 entitled "ACOUSTIC HORN ARRANGEMENT" and filed on 22 Jun. 2011. The content of this application is hereby incorporated by reference in its entirety.

INCORPORATION BY REFERENCE

The following publications are referred to in the present application and their contents are herby incorporated by reference in their entirety:

Murphy, D. J., Morgans, R., 'Modelling Acoustic Horns with FEA', Audio Engineering Society (AES) 128th Convention, London, United Kingdom, Paper No.8076, (May 2010); and U.S. Pat. No. 4,308,932 entitled "Loudspeaker Horn" filed on 6 May 1980.

TECHNICAL FIELD

The present invention relates to acoustic horns for the reproduction of sound. In a particular form the present invention relates to an acoustic horn arrangement having more than one sound driver input.

BACKGROUND

In audio engineering it is very difficult to produce a single sound driver to operate over the full audio frequency range of 20 Hz to 20,000 Hz (equivalent to wavelengths from 17 m to 17 mm respectively). For low frequency sound, the sound driver itself has to be physically large to generate the low frequency sound pressure with the required amplitude. As the sound frequency increases, the sound driver will tend to exhibit increasingly irregular radiation patterns as its dimensions become comparable to and larger than the radiated wavelengths of sound being generated. Accordingly, a smaller sound driver is needed to radiate a more uniform pattern of sound at these higher audio frequencies. As a consequence, to achieve operation over the full audio bandwidth, typically a plurality of sound drivers is commonly used with larger transducers for lower frequency ranges and progressively smaller sound drivers for high frequency ranges.

It is the general practice to arrange these sound drivers in a vertical array with the higher frequency drivers located at the top of the array. Frequency dependent electronic networks, generally referred to as a "crossover networks" are then used to direct bands of frequencies to the appropriate sound driver for that particular frequency band. An important design goal generally for sound drivers and sound reproduction systems is maintenance of the directional characteristics of the generated sound field over the audio frequency range. This is usually assessed in vertical and horizontal planes which intersect the design axis of the loudspeaker system, that is, the on-axis point at which the frequency response is measured.

One common measure of the directional characteristics of the sound field is termed the "beam angle". This quantity is defined at a given frequency as the angle between the off-axis points that are 6 dB lower than the on-axis sound pressure level (SPL). The design goal is then to maintain the beam angle substantially constant over the audio frequency range of the sound reproduction system. As a consequence, graphs of beam angle versus frequency are often included as part of the data pertaining to a sound reproduction systems as an indication of the directional characteristics of the system.

In the case of multiple sound drivers, a further design goal is to ensure that there is a uniform SPL between the outputs of the sound drivers to create a uniform response across the frequency range. Accordingly, for a sound reproduction system involving two sound drivers at the relevant crossover frequency the output of the two sound drivers is adjusted to radiate equally. Referring now to FIG. 1, there is shown an idealised case of two identical vertically arranged sound drivers 100, 110 of equal strength functioning as omni-directional sources of sound radiation corresponding to this arrangement. While the on-axis frequency response can be adjusted to give a uniform sound output from one sound driver to the next due to the equal path lengths (e.g. 120) from the sound drivers 100, 110, the vertical polar response is affected by dips and nulls as the off-axis path length difference becomes multiples of one half wavelength (e.g. 130) resulting in cancellation occurring.

This effect is depicted in FIG. 2A which shows the polar graph 200 for the arrangement illustrated in FIG. 1 and the null in the generated sound field at the off-axis angle where the path difference is one half wavelength. The effect also occurs at higher frequencies where the difference would be three half wavelengths, five half wavelengths, and so on. FIG. 2B shows an acoustically measured polar graph 210 of two stacked horns at the crossover frequency of 1510 Hz, in which the off-axis nulls are blurred by the finite size of the horns but the beam angle of the main central lobe is smaller than either of the two horns at that frequency. Additional off-axis nulls are seen in this example, as the centres of the horns are two wavelengths apart at the crossover frequency. This vertical off axis cancellation whose directional characteristics will vary as a function of wavelength degrades the design goal of achieving a uniform vertical beam angle over the frequency range of the sound reproduction system.

Referring now to FIGS. 3A and 3B there are shown side and top diagrams of a typical acoustic horn 300 as is known in the art. An acoustic horn 300 is a structure which utilises continuous outwardly flaring rigid walls 330 to provide an expanding passage for acoustic energy originating from a sound driver 310 located at a throat entrance 320 and radiating towards a mouth exit 340. The throat section 321 of acoustic horn 300 extends away from the throat entrance 320 into a feeder section 322 that is generally rectangular in transverse cross-sectional shape. The feeder section 322 has an expanding transverse area formed by a first pair of walls 331 that diverge outwardly from each other, and a second pair of walls 332 that are substantially parallel and joined to the first pair 331. As such, the configuration of acoustic horn 300 defines both vertical and horizontal directions with respect to the acoustic horn as depicted by the V and H arrows depicted in FIGS. 3A and 3B respectively.

The mouth exit 340 of the horn has a rectangular configuration and is formed by a bell section 323 having walls diverging outwardly from the end of the feeder section consisting of a first pair of diverging walls 333, and a second pair of diverging walls 334 that join with the first pair of walls 333 of the bell section 323 along the edges to form an integral unit. The walls 333, 334 of the bell section 323 may be flared outwardly an additional amount at a transverse plane immediately adjacent to the mouth to provide improved control of the radiation of acoustic energy. It is understood that feeder section 322 may be quite short in some implementations and that the mouth exit 340 may be square depending on the required characteristics of the horn.

The divergence angle between the first pair of walls 331 and between the second pair of walls 334 of the bell section 323 generally determines the dispersion angle of the acoustical energy. A further refinement of acoustic horn 300 is known as a Constant Directivity (CD) horn where the horn geometry is optimised to have a predetermined area of coverage typically defined by the coverage angle in a horizontal plane by the coverage angle in a vertical plane (e.g. 90° by 40° or 60° by 40°).

Referring now to FIG. 4A, there is shown a figurative depiction of the side view of the simulated sound field 450 produced by an exemplar of a constant directivity acoustic horn 400 having a centreline 480 similar to the type depicted in FIGS. 3A and 3B assuming a sound frequency of 4000 Hz. Acoustic horn 400 includes a throat 421 where the sound driver (not shown) is located and a mouth 440. The simulated sound field 450 of acoustic horn 400 represents a map of the acoustic phase of the sound energy within the horn 400 where darker regions 410 indicate areas of positive phase and lighter regions 415 represent areas of negative phase. Acoustic phase has been adopted in this depiction as it provides a clearer delineation of the wave fronts of the sound propagating through the acoustic horn. White lines 430 have been inserted to indicate the spherical wavefronts of the sound field 450. FIG. 4B shows the polar graph obtained at a nominal frequency of 4000 Hz, and FIG. 4C shows the vertical and horizontal beam angles over the principal audible range between 500 Hz to 8 kHz, indicating the base line performance of a standard acoustic horn.

One attempt to address the problem with standard arrays of sound drivers referred to above is to arrange the sound drivers in a concentric or collinear arrangement. The problem then shifts to that of devising a method for allowing the radiation of sound from the same point in space, or from collinear closely spaced acoustic sources of sound radiation. Digital signal processing techniques have been developed that allow for different time delays to be implemented for collinear closely spaced sources so that the generated sound field can effectively come from the same point.

One such arrangement involves installing a smaller acoustic horn in the mouth of a larger acoustic horn and is shown in FIG. 3C. In this arrangement, the smaller horn 391 obstructs the mouth of the larger horn 392 and in effect turns the larger horn 392 into a ring radiator of acoustic energy. Considering a cross section in the vertical plane, the smaller horn 391 blocks sound radiation from the centre of the larger horn 392, thereby effectively creating two sources, upper and lower, similar in respect to that illustrated in FIG. 1. This then again results in path length differences at off-axis angles and the vertical polar response is once again affected by dips and nulls as the off axis path length difference becomes multiples of one half a wavelength and cancellation occurs as shown in FIG. 2A. A similar observation applies'to a sectional view taken in the horizontal plane. In effect the smaller horn 391 'shadows' the central part of the mouth of the larger horn 392 as shown in FIG. 3C.

A further arrangement that has been proposed is the use of a single source such as an acoustic horn that is driven by more than one driver and accordingly there have been a number of attempts to combine multiple sound driver outputs into a unified acoustic horn geometry of the type depicted in FIGS. 3A and 3B. One configuration involves the vertical stacking of separate horn elements within the shared side walls of the acoustic horn. However, this configuration also has the disadvantage of once again effectively creating two vertically space acoustic sources with a resultant polar radiation graph as depicted in FIG. 2.

Another potential configuration is to introduce sound from multiple sound drivers, into the acoustic horn by an aperture, functioning as a sound transfer or interface region. In this arrangement, the horn will typically be driven by a first sound driver located on axis at the throat entrance of the acoustic horn that generates sound in a first frequency range and then include one or more further sound drivers generating sound in other frequency ranges, this sound then being introduced into the horn via an aperture or series of apertures located in the walls of the acoustic horn.

The introduction of sound from one or more additional sound drivers into the acoustic horn via the interface region results in a modification of the sound field generated by the central sound driver driving the acoustic horn which adversely affects directional characteristics of the resultant combined sound field radiated by the acoustic horn. This effect primarily results from the interaction of the sound field of the first central sound driver with the interface region which is necessary to introduce into the acoustic horn the sound from the second sound driver.

This effect is depicted in FIGS. 5A to 5D where the applicant has conducted a number of simulations and measurements directed to a variety of different aperture or interface region arrangements 520 located in the walls of the acoustic horn. In each case A to D it is found that there are substantial variations in the beam angle versus frequency. It is postulated that the wavefronts of the sound field from the first sound driver located at the throat of the horn are distorted as a result of the aperture or apertures responsible for introducing sound from a second driver. It can be seen that while the initial wavefront 500 is spherical, the wavefront is then modified by the interface region and remains modified as it propagates towards the mouth resulting in a distorted and sub-optimal wavefront 510.

As would be appreciated by those of ordinary skill in the art spherical wavefronts area necessary but not sufficient condition of a monotonic polar response i.e. the maximum SPL occurs on-axis, and progressively reduces the further the observation point moves off-axis. The shape of the polar response and hence the beam angle between the −6 dB points is determined by the smoothness or otherwise of the variation of SPL from a maximum on-axis to a lower level at right angles to the axis of the horn.

There is therefore a need for an acoustic horn arrangement which is capable of being driven by multiple sound drivers to increase the frequency range of the acoustic horn while still substantially maintaining the horn's directional characteristics.

SUMMARY

In a first aspect the present invention accordingly provides an acoustic horn arrangement including:

- an acoustic horn;
- a first sound driver operable to drive the acoustic horn;
- a second sound driver further operable to drive the acoustic horn; and
- an interface region where sound from the second sound driver transfers into the acoustic horn to combine with sound from the first sound driver, wherein the interface region is adapted to reduce changes in a beam angle measure of the acoustic horn as a function of frequency.

In another form, the sound from the first sound driver is generated in a first frequency range and the sound from the second sound driver is generated in a second frequency range.

In another form, the first sound driver is located at a throat of the acoustic horn.

In another form, the acoustic horn arrangement has constant directivity characteristics.

In another form, the configuration of the acoustic horn arrangement defines vertical and horizontal directions with respect to the acoustic horn and wherein the interface region is adapted to reduce changes in the vertical beam angle of the acoustic horn as a function of frequency.

In another form, the interface region includes at least one aperture and wherein the at least one aperture is located to substantially minimise a proportion of area of the at least one aperture that lies on a centre line of the acoustic horn.

In another form, the at least one aperture is elongate generally in the direction of sound propagating down the acoustic horn.

In another form, the at least one aperture is oriented to follow a streamline of the sound from the first sound driver.

In another form, the at least one aperture has a rectangular slit configuration.

In another form, the at least one aperture has a tapered or wedge shape slit configuration.

In another form, a width of the tapered or wedge shape slit configuration is held to be a substantially constant fraction of a dimensional characteristic of the acoustic horn.

In another form, the dimensional characteristic is the circumference of the acoustic horn.

In another form, the dimensional characteristic is the cross sectional area of the acoustic horn.

In another form, the at least one aperture has a kite shaped configuration.

In another form, the at least one aperture has a truncated kite shape configuration.

In another form, the acoustic horn has a rectangular cross-section.

In another form, the acoustic horn has an elliptical cross-section.

In another form, the interface region is further adapted to modify a cavity resonance frequency caused by a cavity formed between the interface region and the second sound driver to substantially minimise the effect of the cavity resonant frequency on the on-axis frequency response of the first sound driver.

In another form, the interface region is adapted to modify the cavity resonance frequency by a phase plug member incorporating apertures connecting the air space of the second sound driver to the air in the acoustic horn.

In a second aspect the present invention accordingly provides an acoustic horn arrangement including an acoustic horn operable to be driven by a first sound driver, the acoustic horn arrangement further including two or more additional sound drivers each introducing sound into the acoustic horn by a respective interface region, wherein the respective interface region for each of the two or more additional sound drivers is adapted to reduce changes in the beam angle of the acoustic horn as a function of frequency in accordance with the first aspect of the present invention.

In a fourth aspect the present invention accordingly provides a sound reproduction system including the acoustic horn arrangement in accordance with the first or second aspects of the present invention.

In a fifth aspect the present invention accordingly provides an interface arrangement for transferring sound from a secondary sound driver into an acoustic horn driven by a first sound driver, the interface arrangement including a phase plug member to define the path length and volume of air of a cavity defined by the secondary sound driver and the interface region, wherein the phase plug member is adapted to modify the cavity resonant frequency to substantially minimise the effect of the cavity on the on-axis frequency response of the first sound driver.

In another form, the phase plug member incorporates apertures connecting the air space of the second sound driver to the air in the acoustic horn.

BRIEF DESCRIPTION OF DRAWINGS

Illustrative embodiments of the present invention will be discussed with reference to the accompanying drawings wherein:

FIG. 8A is a figurative sectional view illustrating an acoustic horn arrangement and the simulated associated sound field including an adapted interface region to reduce changes in the beam angle of the acoustic horn as a function of frequency in accordance with a first illustrative embodiment of the present invention;

FIG. 8B shows the simulated polar graph at 4000 Hz of the acoustic horn arrangement illustrated in FIG. 8A;

FIG. 11A is a figurative sectional view illustrating an acoustic horn arrangement and the simulated associated sound field including an adapted interface region to reduce changes in the beam angle of the acoustic horn as a function of frequency in accordance with a fourth illustrative embodiment of the present invention;

FIG. 11B shows the simulated polar graph at 4000 Hz of the acoustic horn arrangement illustrated in FIG. 11A;

In the following description, like reference characters designate like or corresponding parts throughout the several views of the drawings.

DESCRIPTION OF EMBODIMENTS

Figure 1:
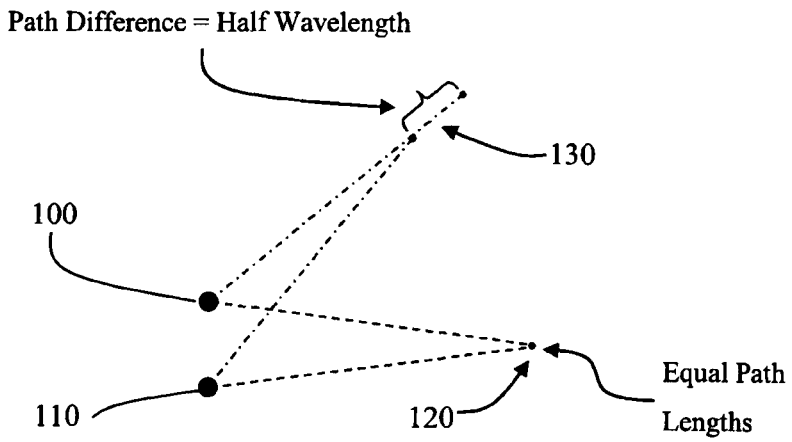
FIG. 1 is a figurative diagram of two identical omni-directional sources of sound radiation depicting the path length differences that cause off-axis sound wave cancelling.
Figure 2A:
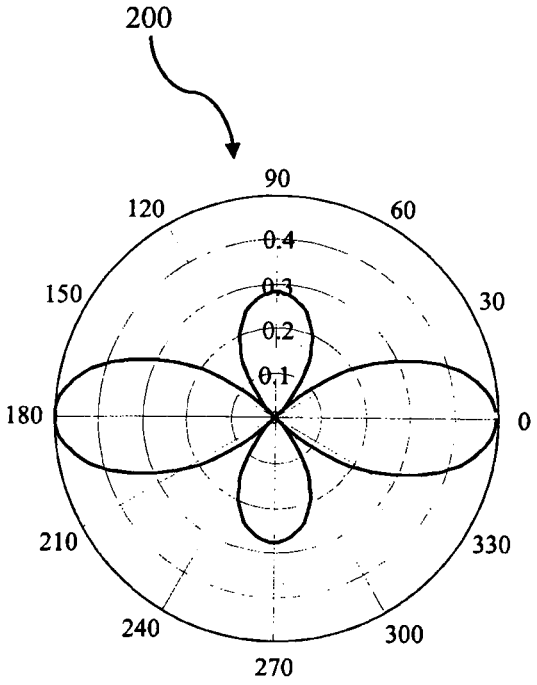
FIG. 2A is an idealised polar graph of the radiated sound field of the arrangement illustrated in FIG. 1.
Figure 2B:
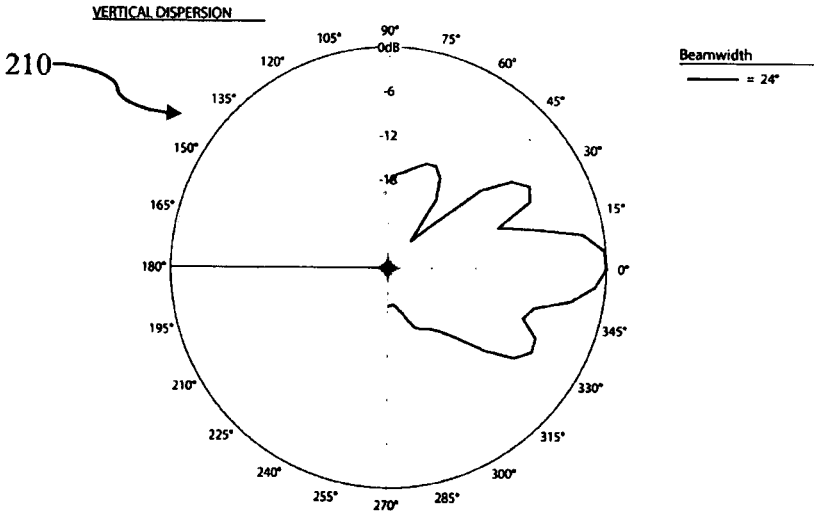
FIG. 2B is an actual measured polar graph of a system similar to that illustrated in FIG. 1 at its crossover frequency, showing two off-axis nulls above and blurred off-axis nulls below the design axis.
Figure 3A:
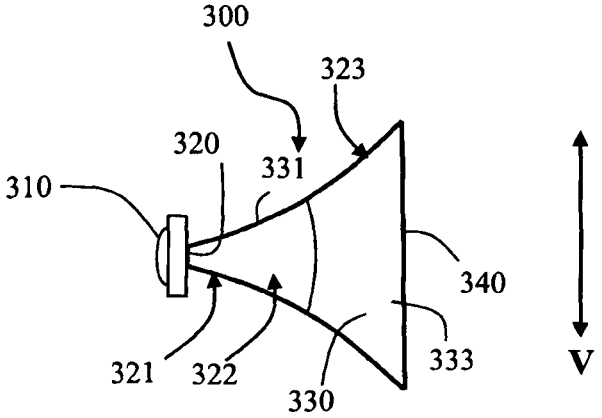
Figure 3A (prior art)
FIGS. 3A and 3B are side and top diagrams of a representative constant directivity (CD) acoustic horn.
Figure 3B:
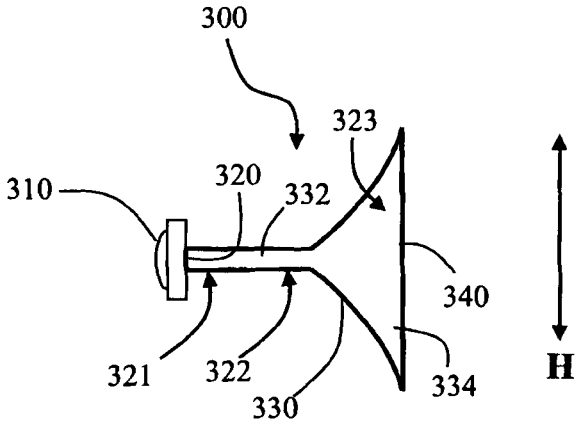
Figure 3B (prior art)
Figure 3C:
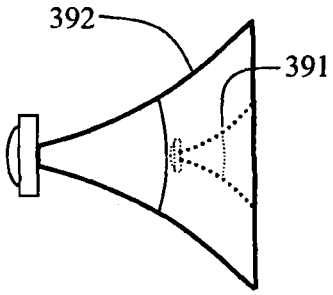
Figure 3C (prior art)
FIG. 3C is a side view diagram of a representative horn within a horn arrangement.

The simulated sound field results referred to throughout the specification are produced by Finite Element Analysis (FEA) employing COMSOL™ modelling software. The FEA method solves numerically the ideal, linear wave equation governing the propagation of sound assuming a given horn geometry but does not include any damping as would exist in the real system. Typically a CAD (computer) model of the internal shape of the acoustic horn is created in three dimensions, and imported into the FEA software. A suitable shape for the air in front of the horn is created, so that a realistic acoustic load is presented to the mouth of the horn. Frequently a quarter model can be used, exploiting the symmetry of the acoustic horn arrangement and reducing the computational size of the problem.

Once the CAD model of the acoustic horn is successfully imported, appropriate acoustic boundary conditions can be applied, such as acceleration to the surface(s) of diaphragm(s), absorption to the surfaces of the air in front of the mouth, absorption (damping) of selected internal surfaces, and so on. Post processing of the raw acoustic pressure results is needed to calculate the far-field SPL in decibels (dB) at 3 meters and to then further process the off-axis SPL results to produce polar graphs and beam angle numbers as referred to throughout the specification. The simulations referred to in this specification have been carried out with a minimal amount of damping to better show variations in beam angle.

Further details regarding the modelling approach adopted throughout the specification may be found in Murphy, D. J., Morgans, R., 'Modelling Acoustic Horns with FEA', Audio Engineering Society (AES) 128$^{th}$ Convention, London, United Kingdom, Paper No. 8076, (May 2010) whose contents are hereby expressly incorporated by reference in their entirety. This paper also shows comparison graphs of simulated versus measured on-axis SPL and simulated versus measured beam angle with respect to frequency.

Throughout the specification the term "sound driver" is taken to mean an electro-acoustic transducer which converts electrical energy into acoustical energy by means of a vibrating diaphragm. The vibration of the diaphragm is effected by an attached electrical conductor, usually a coil, immersed in a strong magnetic field. Examples include, but are not limited to, cone loudspeakers, dome tweeters, compression drivers, and ribbon loudspeakers. Other electro-acoustic conversion principles are possible, for example piezo-electric or electrostatic.

Referring now to FIGS. 6A-E, and by way of exemplification, there is shown a detailed analysis of the horn configuration first illustrated in FIG. 5A designed to provide a sound reproduction device having a wide frequency range and good off-axis characteristics where the introduction of sound in a second frequency range into the acoustic horn 600 from the second sound driver 670 is via an interface region 690 having a square aperture 695 in the side wall of acoustic horn 600 and which combines with sound from a first sound driver (not shown) located at the throat 621 of acoustic horn 600.

Figure 4A:
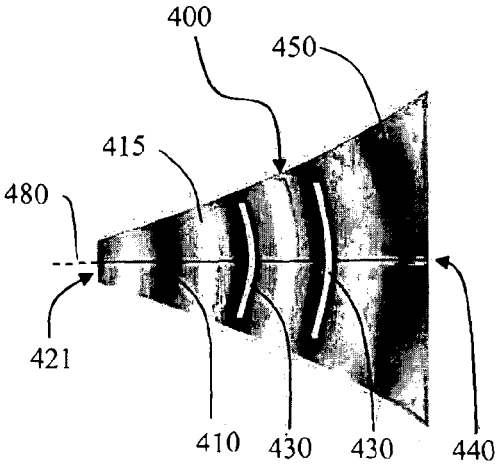
FIG. 4A is a figurative sectional view illustrating the simulated sound field propagating through an acoustic horn of the type illustrated in FIGS. 3A and 3B having optimal spherical wavefronts.
Figure 6A:
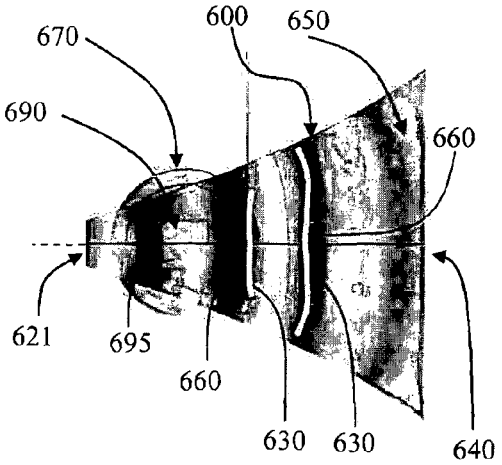
FIG. 6A is a figurative sectional view illustrating the change in the simulated sound field propagating through the acoustic horn caused by an interface region configuration for the second sound driver in accordance with FIG. 5A.

As has been determined by simulations, the resultant sound field 650 is adversely affected by the presence of this aperture 695 which causes a local retardation or distortion 660 in the wave front 630 causing in this case a partial inversion of the desired spherical wavefront (as illustrated in FIG. 6A) as it travels towards mouth 640. This effect is frequency dependent and manifests itself in a modified polar pattern at this frequency resulting in a change in the beam angle of the radiated sound from the beam angle at other frequencies and from the same horn without any interface region such as depicted in FIGS. 4A-C.

Figure 4B:
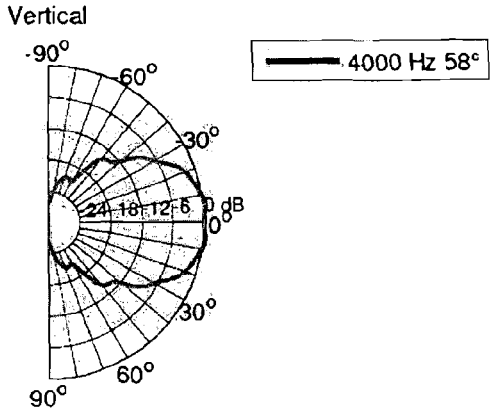
FIG. 4B shows the simulated polar graph of the acoustic horn illustrated in FIG. 4A showing the −6 dB points and the beam angle calculated between those points.
Figure 4C:
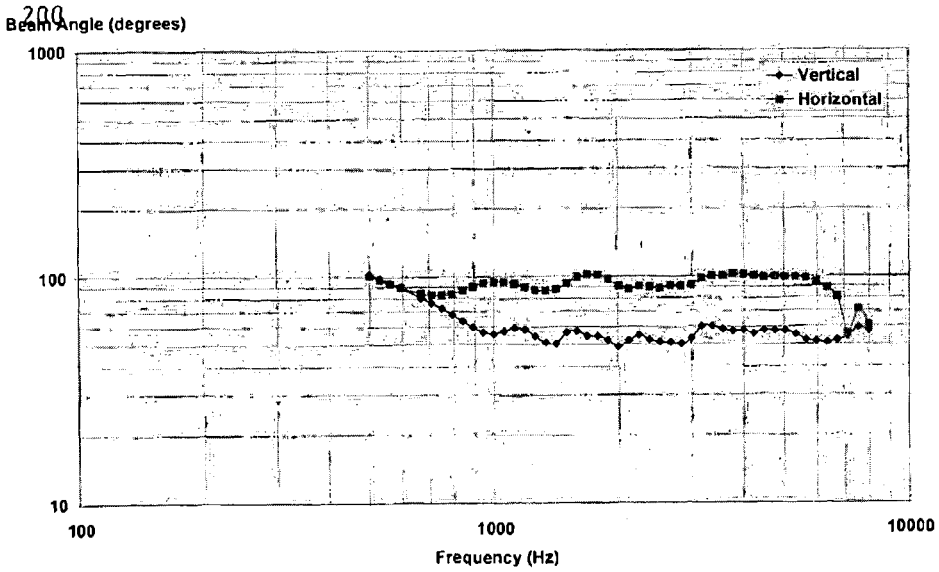
FIG. 4C is a graph of the calculated vertical and horizontal beam angles as a function of frequency of the acoustic horn illustrated in FIG. 4A.
Figure 6B:
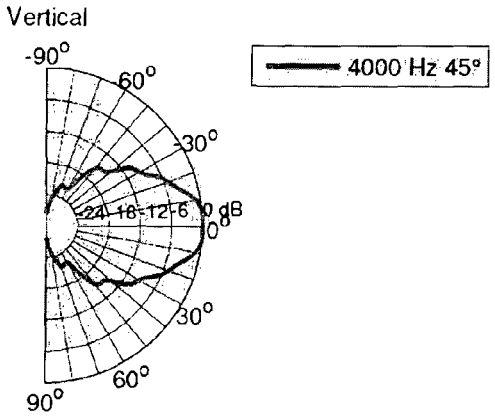
FIG. 6B shows the simulated polar graph at 4000 Hz of an acoustic simulation of the acoustic horn arrangement illustrated in FIG. 6A.
Figure 6C:
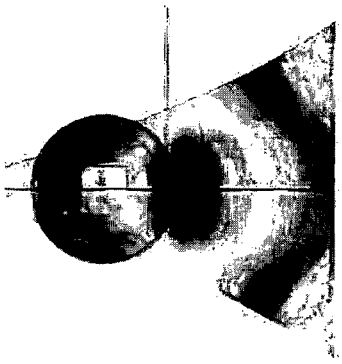
FIGS. 6C and 6D show the simulated wavefront disturbance and polar graph at a selected frequency of the acoustic horn arrangement illustrated in FIG. 6A.
Figure 6D:
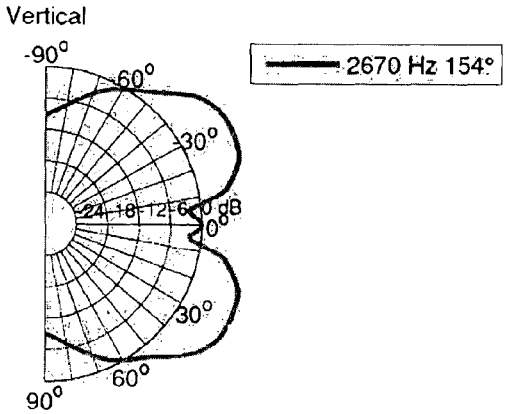
Figure 6E:
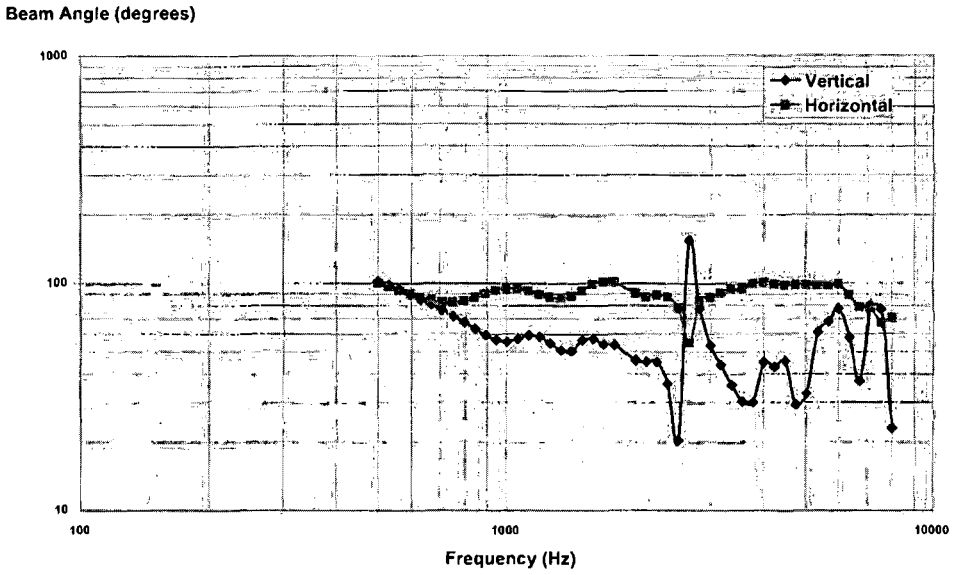
FIG. 6E is a graph of the calculated vertical and horizontal beam angles as a function of frequency of the acoustic horn arrangement illustrated in FIG. 6A.

FIG. 6B shows a polar graph at a nominal frequency of 4000 Hz with a narrower beam angle than the equivalent simple acoustic horn illustrated in FIG. 4B. FIGS. 6C and 6D show the wavefronts and polar graphs at a selected frequency of 2670 Hz where there is considerable change in the beam angle. FIG. 6E shows the changes in vertical and horizontal beam angles over a frequency range between 500 Hz to 8 kHz. Note that the horizontal beam angle shows a small variation from that obtained from the simple acoustic horn with clean sides such as depicted in FIG. 4C. As would be appreciated by those of ordinary skill in the art, the departure from the spherical wavefront as depicted in FIGS. 6A and 6C changes the polar performance and hence the beam angle at that frequency and other related frequencies.

Referring now to FIGS. 7A-E, there is shown a detailed analysis of the horn configuration first illustrated in FIG. 5D which has been postulated to provide a sound reproduction device having a wide frequency range and good off-axis characteristics where the introduction of sound in a second frequency range into the acoustic horn 700 from the second sound driver 770 is via an interface region 790 having a square array of holes 795 in the side wall of acoustic horn 700 and which combines with sound from a first sound driver (not shown) located at the throat 721 of acoustic horn 700.

Figure 7A:
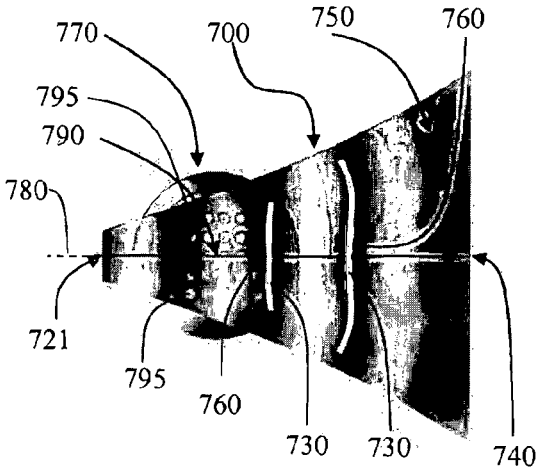
FIG. 7A is a figurative sectional view illustrating the change in the simulated sound field propagating through the acoustic horn caused by an interface region configuration for the second sound driver in accordance with FIG. 5D.

Similar to the horn configuration shown in FIGS. 6A-E, the resultant sound field 750 is adversely affected by the presence of these apertures 795 which again cause a local retardation or distortion 760 in the wave front 730 causing in this case a partial inversion of the desired spherical wavefront (as illustrated in FIG. 7A) as it travels towards mouth 740. This effect is frequency dependent and manifests itself in a modified polar pattern at this frequency resulting in a change in the beam angle of the radiated sound from the beam angle at other frequencies and from the same horn without any interface region such as depicted in FIGS. 4A-C.

Figure 7B:
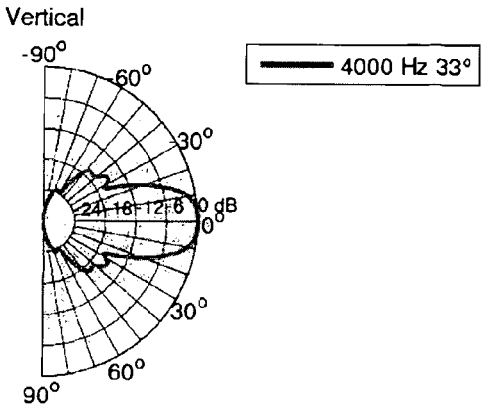
FIG. 7B shows the simulated polar graph at 4000 Hz of an acoustic simulation of the acoustic horn arrangement illustrated in FIG. 7A.
Figure 7C:
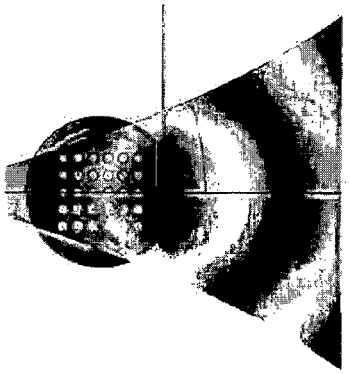
FIGS. 7C and 7D show the simulated wavefront disturbance and polar graph at a selected frequency of the acoustic horn arrangement illustrated in FIG. 7A.
Figure 7D:
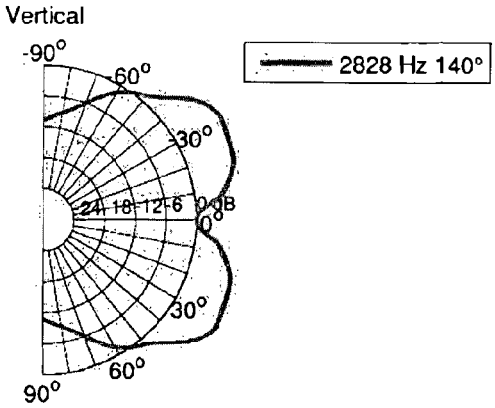
Figure 7E:
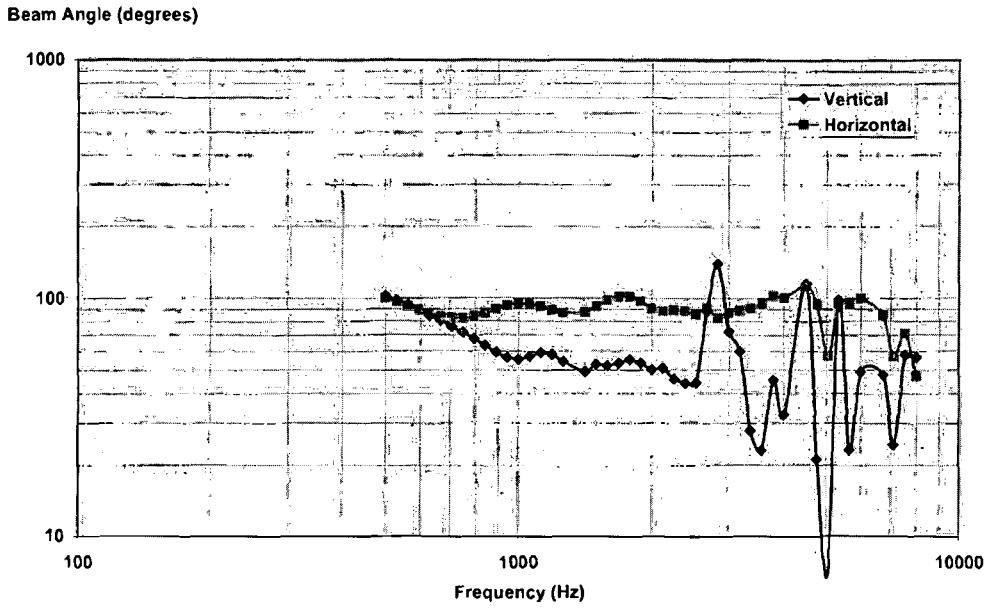
FIG. 7E is a graph of the calculated vertical and horizontal beam angles as a function of frequency of the acoustic horn arrangement illustrated in FIG. 7A.

FIG. 7B shows a polar graph at a nominal frequency of 4000 Hz with a narrower beam angle than the equivalent simple acoustic horn illustrated in FIG. 4B and which is further narrower again than the beam angle of the horn configuration shown in FIGS. 6A-E as can be seen by comparing FIGS. 7B and 6B. FIGS. 7C and 7D show the wavefronts and polar graph at a selected frequency of 2828 Hz where there is considerable change in the beam angle. As with FIG. 6E, FIG. 7E is a graph that shows the changes in vertical and horizontal beam angles over a frequency range between 500 Hz to 8 kHz. Note again that the horizontal beam angle shows a small variation from that obtained from the simple acoustic horn with clean sides such as depicted in FIG. 4C. As would be appreciated by those of ordinary skill in the art, the departure from the spherical wavefront as depicted in FIGS. 7A and 7C changes the polar performance and hence the beam angle at that frequency and other related frequencies.

As can be seen from the detailed simulations carried out with respect to the horn configurations depicted in FIGS. 6A and 7A and as discussed previously, the addition of an aperture to introduce sound from a second driver causes substantial changes in the beam angle of the acoustic horn as a function of frequency.

Referring now to FIG. 8A, there is shown an acoustic horn arrangement including an acoustic horn 800 that is driven by first sound driver (not shown) located at its throat 821. Acoustic horn 800 further includes an interface region 890 located in a wall region of acoustic horn 800 for introduction of sound from a second sound driver 870 adapted in accordance with a first illustrative embodiment of the present invention. In this illustrative embodiment; the interface region of the acoustic horn is adapted by locating the aperture (or apertures) 895 to substantially minimise a proportion of area of the apertures that lies on the centre line 880 of acoustic horn 800. In this illustrative embodiment, the apertures are also elongate generally in the direction of sound propagating down the acoustic horn 800 towards the mouth 840 and have a rectangular slit configuration.

By not having or substantially minimising any portion of the aperture or apertures 895 along the centreline 880 of the acoustic horn 800, the effect of the distortion to the central region of the wavefront 830 of the sound field from the first sound driver (not shown) located at the throat 820 of the acoustic horn 800 is reduced.

Figure 8C:
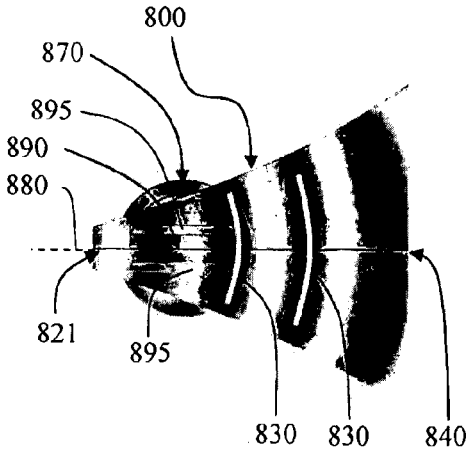
FIG. 8C is a graph of the calculated vertical and horizontal beam angles as a function of frequency of the acoustic horn arrangement illustrated in FIG. 8A.

Comparing the variation in vertical beam angle as function of frequency of this first illustrative embodiment as depicted in FIG. 8C with the variation of vertical beam angle shown in FIGS. 6E or 7E it can be seen that there is a substantial reduction in the variation of vertical beam angle with the degree of variation approaching more closely that expected for a simple acoustic horn with clean sides involving no introduction of sound from a second sound driver as depicted in FIG. 4C.

FIG. 8B which shows the polar graph at a nominal frequency of 4000 Hz shows a broadening of the beam angle in comparison to the polar response shown in FIGS. 6B and 7B approaching the polar response of the equivalent simple acoustic horn illustrated in FIG. 4B. This improvement in performance in vertical beam angle can also be seen in Table 1 where the standard deviation (i.e. the variation of vertical beam angle with respect to the average vertical beam angle) is substantially improved when compared to the arrangements depicted with respect to FIGS. 6 and 7.

As expected, while there is some degradation of the variation in horizontal beam angle of the square aperture or square array interface regions as shown in FIGS. 6E and 7E and improvement of this aspect of performance in FIG. 8C as compared to the simple acoustic horn depicted in FIG. 4C, the primary improvement in the beam angle performance is with respect to the vertical dimension. However, there is still some improvement in the horizontal beam angle performance.

Figure 9A:
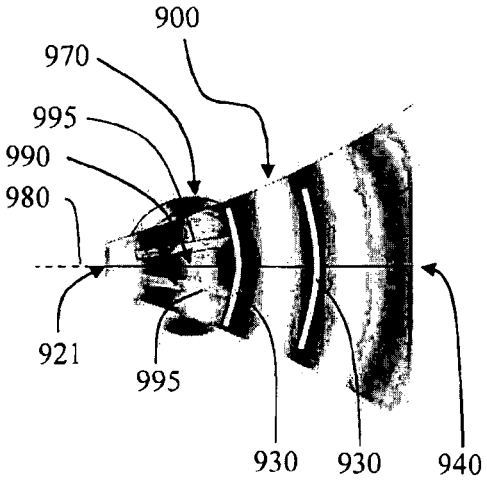
FIG. 9A is a figurative sectional view illustrating an acoustic horn arrangement and the simulated associated sound field including an adapted interface region to reduce changes in the beam angle of the acoustic horn as a function of frequency in accordance with a second illustrative embodiment of the present invention.

Referring now to FIG. 9A, there is shown an acoustic horn arrangement including an acoustic horn 900 having an interface region 990 located in a wall region for introduction of sound from a second sound driver 970 adapted in accordance with a second illustrative embodiment of the present invention. In this illustrative embodiment, the interface region 990 has been adapted to reduce changes in the beam angle as a function of frequency by first locating the apertures 995 off the centre line 980 of acoustic horn 900 and further by orienting the apertures 995 substantially at right angles or along the streamlines of sound generated from the first sound driver (not shown) located at the throat 921 of the acoustic horn 900 as it travels towards mouth 940. As with the first embodiment, the apertures are also elongate generally in the direction of sound propagating down the acoustic horn 900 towards the mouth 940 and have a rectangular slit configuration. In this case, for this horn geometry the appropriate angle of orientation is 8.5°.

Figure 9B:
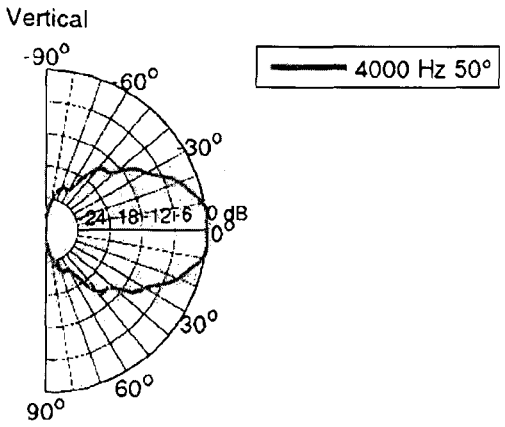
FIG. 9B shows the simulated polar graph at 4000 Hz of the acoustic horn arrangement illustrated in FIG. 9A.
Figure 9C:
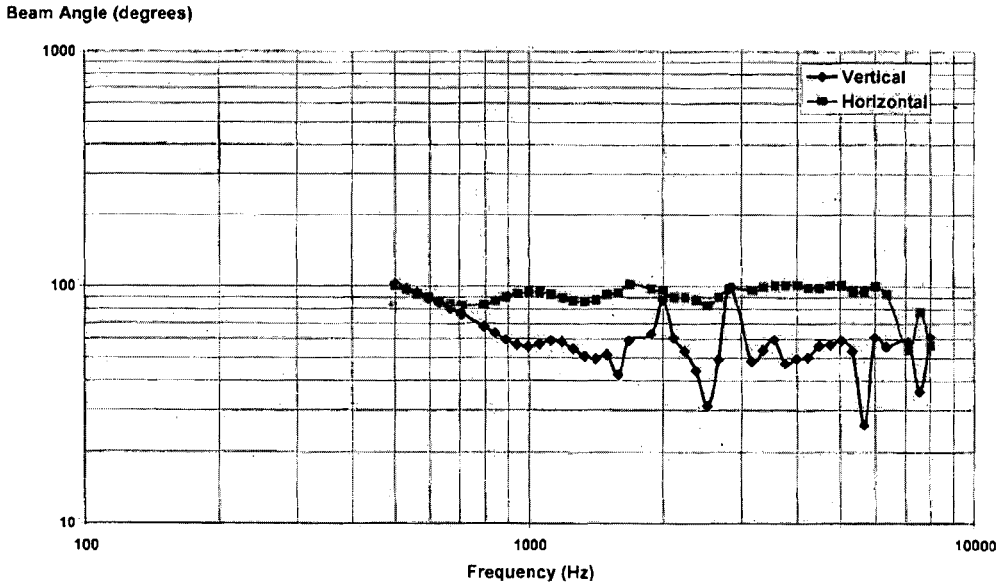
FIG. 9C is a graph of the calculated vertical and horizontal beam angles as a function of frequency of the acoustic horn arrangement illustrated in FIG. 9A.

As shown in FIG. 9A and 9B, by adopting this configuration of apertures 995 i.e. located off the centreline 980 of the acoustic horn 800 and further orienting the apertures along a streamline, it is apparent that the effect of the distortion is reduced to the central region of the wavefront 930 of the sound field from the first sound driver (not shown) located at the throat 921 of the, acoustic horn 900. Referring again to Table 1 and also to FIG. 9C, it is apparent that this arrangement further improves the vertical beam angle performance as noted by the decrease in the standard deviation. Note again that the horizontal beam angle shows minimal variations from that obtained from the acoustic horn with clean sides as shown in FIG. 4C.

It is postulated that orienting the aperture away from the vertical (or horizontal) centreline profiles results in there being a lesser effect on the propagation of sound along the centreline profiles resulting from the introduced sound from the second sound and hence a lesser effect on the vertical (or horizontal) beam angle.

As would be appreciated by those of ordinary skill in the art, the angle of the streamline and hence the angle of orientation of the aperture will vary according to the geometry and configuration of the horn. One approximate way to determine an appropriate range of angles for orienting the aperture is to calculate the point of intersection of the centreline on the acoustic horn and a line projected backwards from the throat and tangential to the curve of the initial start of the vertical profile of the throat of the acoustic horn (i.e. corresponding to half of the initial start angle of the acoustic horn). In effect, this point is the apparent apex of the acoustic horn and could be considered the apparent centre of the wave fronts propagating down the acoustic horn. A line drawn from this point forwards into the throat feeder section intersecting the proposed location of the aperture as offset from the centreline may then be used to define an angle of orientation for the aperture as this line will lie generally at right angles to the wavefronts originating from the throat, thereby effectively defining the orientation of the stream line at this location.

In one illustrative embodiment, for an acoustic horn of the type described in U.S. Pat. No. 4,308,932 entitled "Loudspeaker Horn" (filed 6 May 1980 and whose contents are hereby expressly incorporated by reference in its entirety) and which has general applicability to the type of horns described here, the initial angle of the start of the throat is empirically found to vary between 60% to 90% of the desired angle of coverage. For an aperture located approximately half way between a location defined by the centreline and a location defined by the start angle of the horn, the optimum orientation of the aperture is found to lie within a range of 40% to 60% of half of the initial start angle of the throat.

In this illustrative embodiment, the initial start angle of 34° is approximately 70% of the desired angle of coverage (nominally 90°×50° (H×V)). Accordingly, in this illustrative embodiment for a half start angle corresponding to 17° it has been found that an aperture orientation angle of 8.5° is preferred.

Figure 10A:
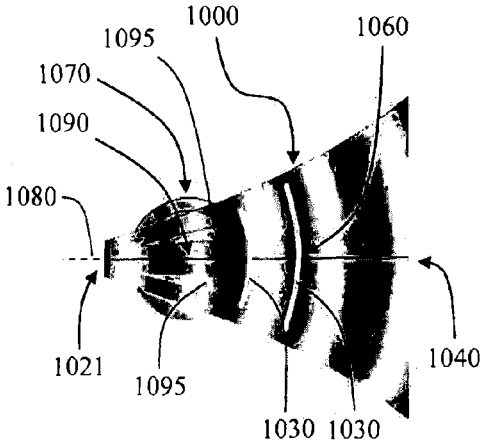
FIG. 10A is a figurative sectional view illustrating an acoustic horn arrangement and the simulated associated sound field including an adapted interface region to reduce changes in the beam angle of the acoustic horn as a function of frequency in accordance with a third illustrative embodiment of the present invention.

Referring now to FIG. 10A, there is shown an acoustic horn arrangement including an acoustic horn 1000 having an interface region 1090 located in a wall region of acoustic horn 1000 for introduction of sound from a second sound driver 1070 in accordance with a third illustrative embodiment of the present invention. In this illustrative embodiment, the interface region 1090 includes two suitably angled tapered or wedge shape slit apertures 1095 with the point of the taper located at the throat entrance 1021 end of acoustic horn 1000 and flaring outwardly from centreline 1080 towards the mouth end 1040 of the acoustic horn. Again, the effect of the distortion 1060 is reduced to the central region of the wavefront 1030 of the sound field from the first sound driver located at the throat 1021 of the acoustic horn 1000.

Figure 10B:
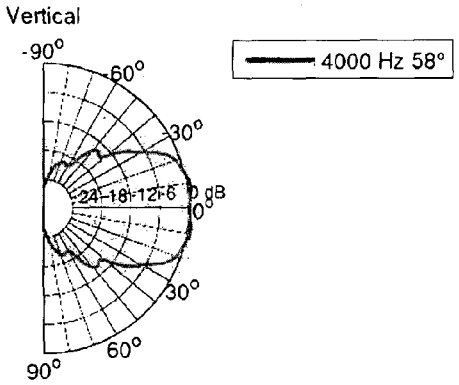
FIG. 10B shows the simulated polar graph at 4000 Hz of the acoustic horn arrangement illustrated in FIG. 10A.
Figure 10C:
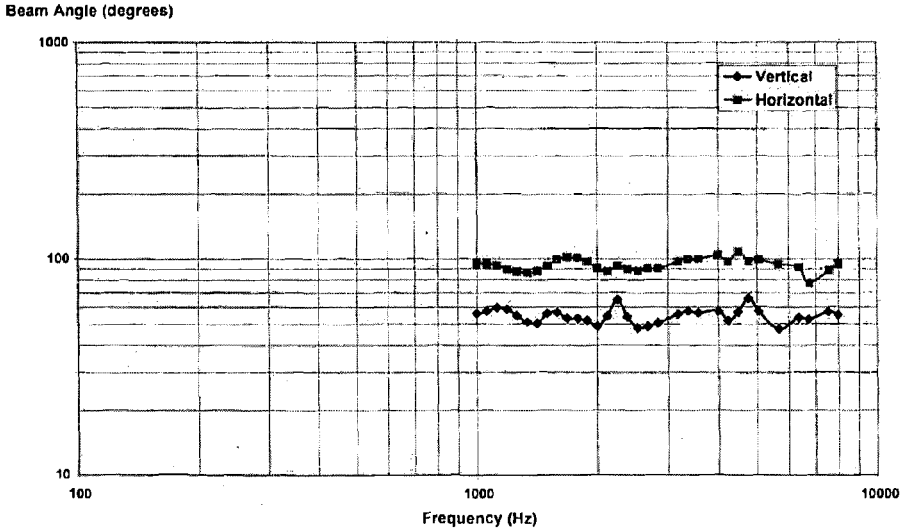
FIG. 10C is a graph of the calculated vertical and horizontal beam angles as a function of frequency of the acoustic horn arrangement illustrated in FIG. 10A.

In this illustrative embodiment, the smoothness of the vertical beam angle as a function of frequency is substantially improved compared to the rectangular slit apertures of the first illustrative embodiment as can be seen by comparing the variation in vertical beam angle between FIGS. 10C and 8C and comparing the relative standard deviations in Table 1. Note again that the horizontal beam angle shows minimal variations from that obtained from the acoustic horn with clean sides as shown in FIG. 4C. Similarly, FIG. 10B shows a substantial improvement of the polar response at a nominal frequency of 4000 Hz approaching the polar graph of the equivalent simple acoustic horn illustrated in FIG. 4B.

Figure 11C:
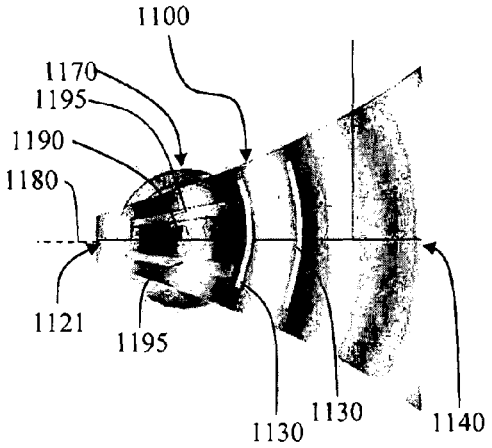
FIG. 11C is a graph of the calculated vertical and horizontal beam angles as a function of frequency of the acoustic horn arrangement illustrated in FIG. 11A.

Referring now to FIG. 11A, there is shown an acoustic horn arrangement including an acoustic horn 1100 having interface region 1190 located in a wall region of acoustic horn 1100 for introduction of sound from a second driver 1170 in accordance with a fourth illustrative embodiment of the present invention representing a further refinement of the taper arrangement of the third illustrative embodiment. In this illustrative embodiment, the interface region 1190 again includes two angled tapered or wedge shape slit apertures 1195 but in this embodiment the width of the tapered or wedge shape slit aperture 1195 is held to be a substantially constant fraction of a dimensional characteristic of the acoustic horn.

In this case, the dimensional characteristic is the circumference of the acoustic horn as it increases over the length of apertures 1195 and the constant fraction is 0.165. In this embodiment, there is virtually no change to the central region of the wavefront 1130 of the sound field from the first sound driver located at the throat 1121 of the acoustic horn 1100 as it travels towards mouth 1140 and FIG. 11B shows an almost equivalent polar graph at 4000 Hz to that depicted in FIG. 4B.

In another illustrative embodiment, the dimensional characteristic is the increasing cross-sectional area of the acoustic horn. This may be calculated on a planar basis or spherical wavefront basis. Typically the circumference of an acoustic horn will follow a quasi-exponential law moving from the throat to the mouth implying that the width of the aperture 1195 will be described by an equivalent function. In another illustrative embodiment, the quasi-exponential variation in width may be approximated by a linear increase in width.

For the particular acoustic horns contemplated throughout the description it is found that the arrangement of holding the width of the aperture to be a constant fraction of a dimensional characteristic of the horn has provided the most effective method of calculation. It provides the best performance in reducing the variation in vertical beam angle as can be seen by comparing FIGS. 11C and 8C and comparing the relative standard deviations in Table 1. It is expected that this is due to the taper in the aperture as depicted in FIG. 10A and more preferably in FIG. 11A providing a more uniform disturbance to the characteristics of the acoustic horn than the disturbance caused by the aperture arrangements depicted in FIGS. 5A-5D an in particular FIGS. 6A-6E and 7A-7E.

Figure 12A:
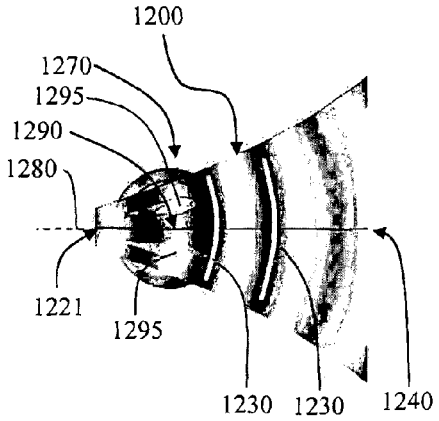
FIG. 12A is a figurative sectional view illustrating an acoustic horn arrangement and the simulated associated sound field including an adapted interface region to reduce changes in the beam angle of the acoustic horn as a function of frequency in accordance with a fifth illustrative embodiment of the present invention.

Referring now to FIG. 12A, there is shown an acoustic horn arrangement including an acoustic horn 1200 having interface region 1290 located in a wall region of acoustic horn 1200 for introduction of sound from a second driver 1270 in accordance with a fifth illustrative embodiment of the present invention. In this illustrative embodiment, the interface region 1290 includes two suitably angled kite or diamond shaped slit apertures 1295. While having better performance than the slit shape aperture of the first and second embodiments described previously, the smoothness of the vertical beam angle graph as shown in FIG. 12C and as can be seen in Table 1 is not as optimal as achieved with the tapered or wedge shaped slit aperture. The applicant postulates that the gradual reduction in area with length past the widest portion of the kite potentially introduces a non-uniform disturbance to the characteristics of an acoustic horn of this configuration.

A tabular summary of the vertical beam angle performance of the acoustic horn arrangements described so far is shown in Table 1. It is calculated on a range of frequencies from 1 kHz to 8 kHz in 1/12 octave spacing. The numeric value of the beam angle is obtained from the calculated polar response at a distance of 3 meters. As has been previously discussed, it can be seen that prior art aperture configurations create considerable variations in the vertical beam angle versus frequency, as evidenced by larger numbers for the standard deviation (Std Dev) whereas aperture configurations in accordance with the present invention show considerable improvements in the smoothness of the beam angle and in particular the vertical beam angle, to the extent that the standard deviation comparable to that of the base line acoustic horn with clean sides may be achieved.

TABLE 1

Summary of Vertical Beam Angle Performance

Figure 5:
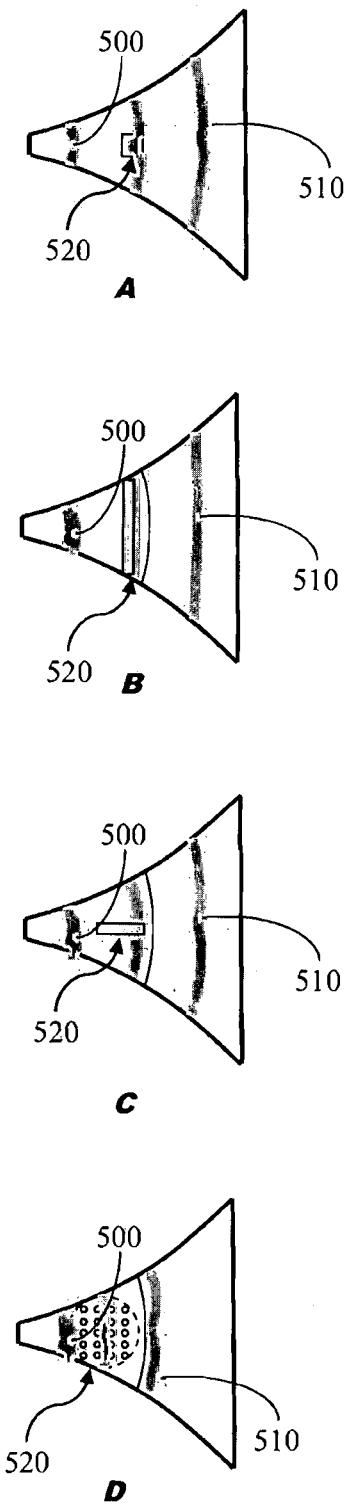
FIGS. 5A to 5D is a series of sectional views illustrating the effect on the sound field propagating through the acoustic horn caused by the interface region for the second sound driver.

| Interface Region | Reference | Average | Std Dev |
|---|---|---|---|
| None | FIG. 5 | 54.8° | 3.2° |
| Unitary rectangular aperture | FIG. 6 | 52.9° | 23.0° |

TABLE 1-continued

Summary of Vertical Beam Angle Performance

Figure 8C:
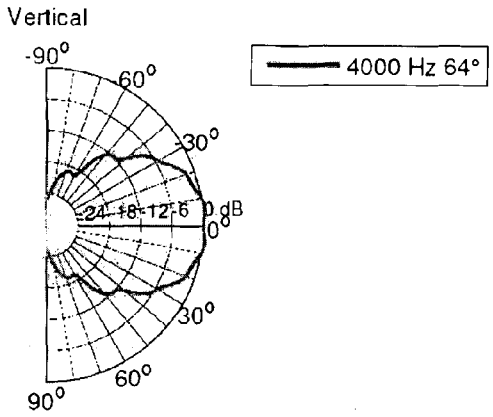
Figure 8C:
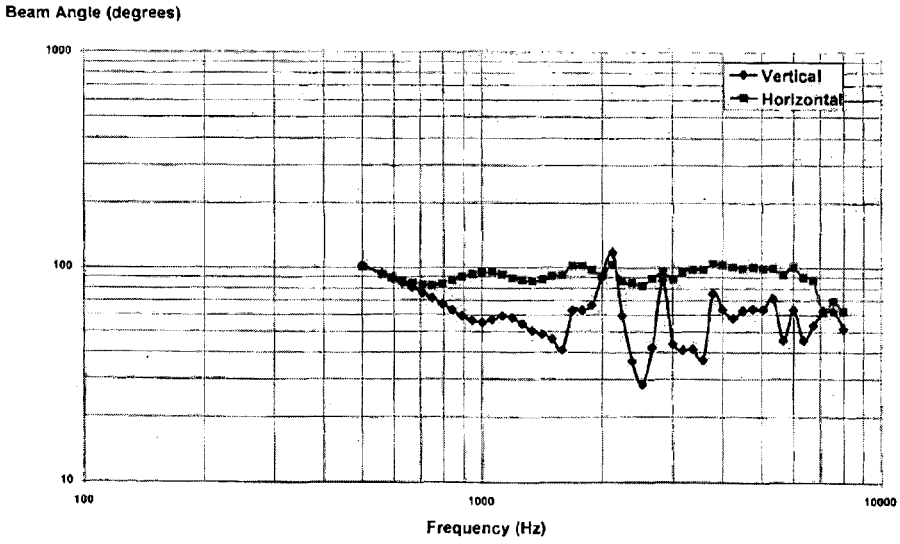
Figure 11C:
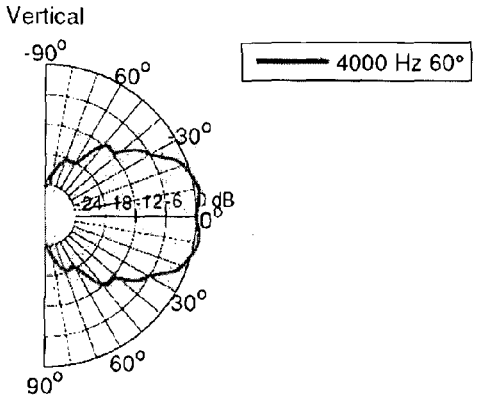
Figure 11C:
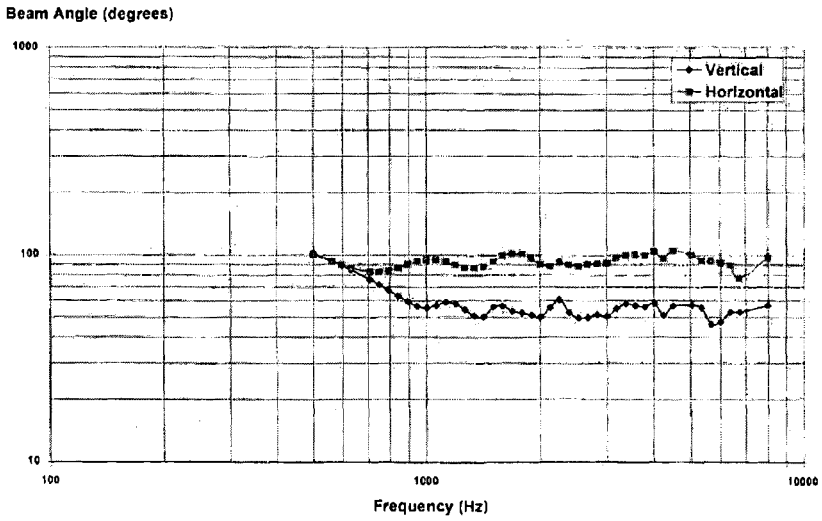
Figure 12B:
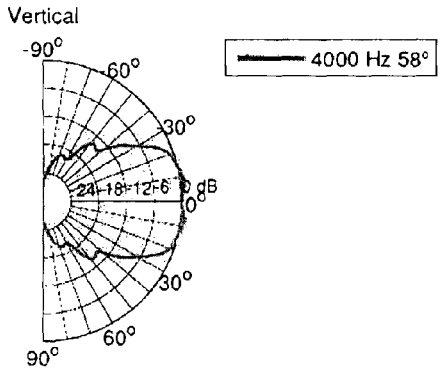
FIG. 12B shows the simulated polar graph at 4000 Hz of the acoustic horn arrangement illustrated in FIG. 12A.
Figure 12C:
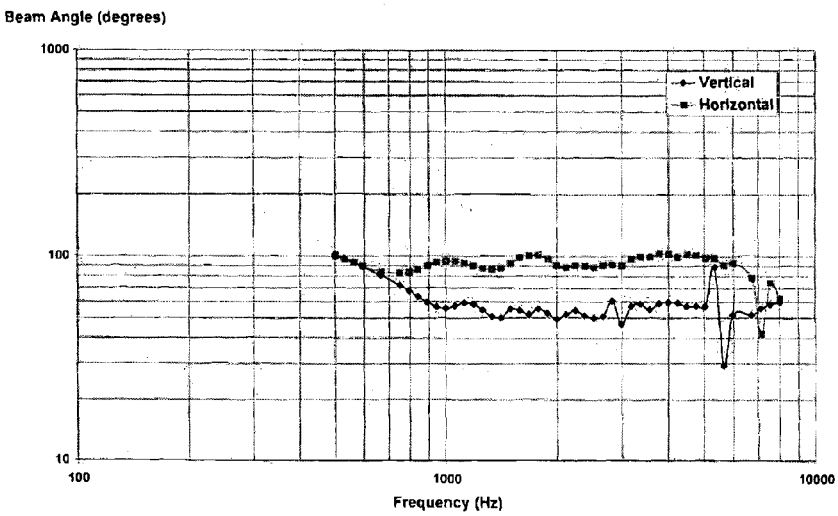
FIG. 12C is a graph of the calculated vertical and horizontal beam angles as a function of frequency of the acoustic horn arrangement illustrated in FIG. 12A.

| Interface Region | Reference | Average | Std Dev |
|---|---|---|---|
| Rectangular array of circular apertures | FIG. 7 | 53.7° | 26.0° |
| Two parallel rectangular apertures | FIG. 8 | 57.7° | 16.8° |
| Two rectangular apertures at 8.5° | FIG. 9 | 54.7° | 12.9° |
| Two tapered apertures at 8.5° | FIG. 10 | 54.6° | 4.3° |
| Two constant fraction tapered apertures at 8.5° | FIG. 11 | 54.0° | 3.6° |
| Two kite shaped apertures at 8.5° | FIG. 12 | 55.2° | 8.0° |

Figure 13A:
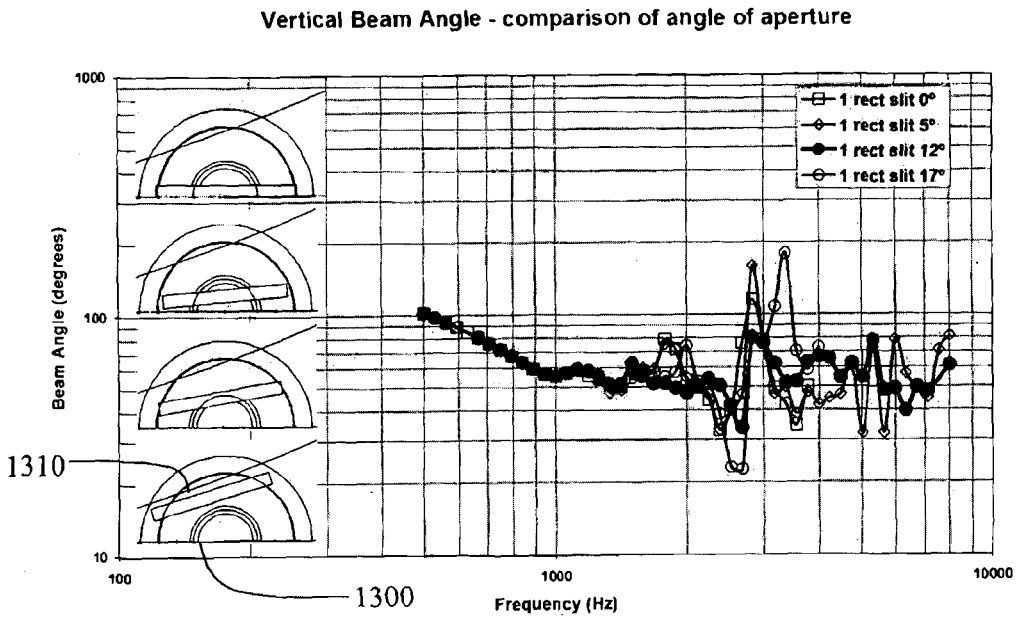
FIG. 13A is a graph of vertical beam angle as a function of frequency showing the variations in vertical beam angle when using a rectangular slit aperture and changing the angle of orientation of the aperture with the centre line of the acoustic horn arrangement.
Figure 13B:
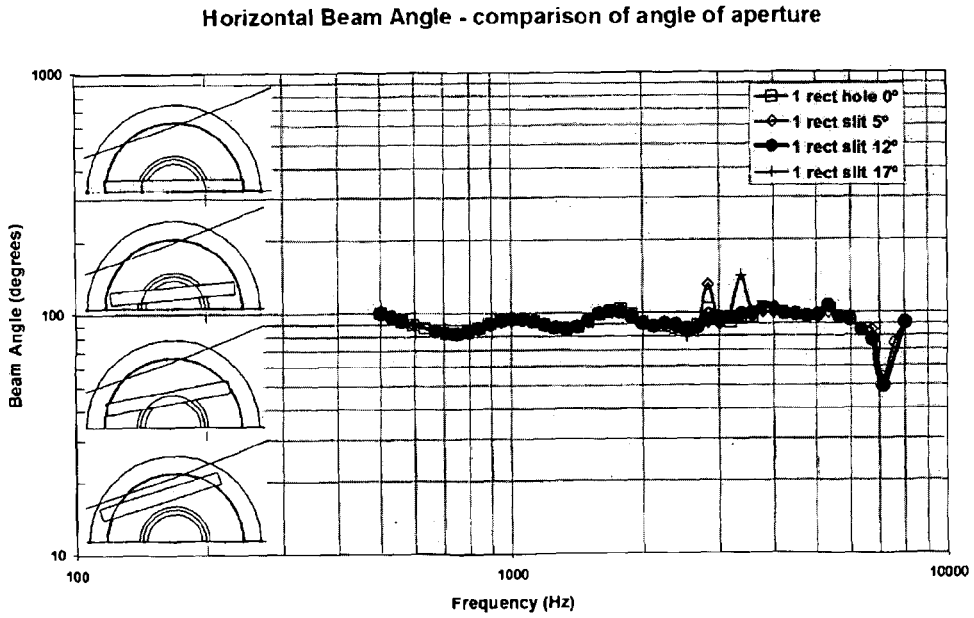
FIG. 13B is a graph of horizontal beam angle as a function of frequency corresponding to the arrangement illustrated in FIG. 13A.

FIG. 13A is a graph of vertical beam angle versus frequency, showing the variations in vertical beam angle when using the same shape of aperture and increasing the angle of orientation of the aperture 1310 with respect to the centreline 1300 from 0° (i.e. on the centreline) to 17°. FIG. 13B is a graph of horizontal beam angle versus frequency showing the variations in horizontal beam angle when using the same shape of aperture and changing the configuration of the aperture with respect to the centreline in a similar manner to FIG. 13A. In this case, the shape of the aperture is rectangular and corresponds to that depicted in FIG. 8. It can be seen that while increasing the angle of orientation generally improves the beam angle performance and in particular the vertical beam angle performance, an optimum angle is reached and vertical beam angle performance then degrades as an angle 17° results in a decrease in performance. It is expected that this is due to the upper edge of the aperture 1310 being too close to the centreline of the vertical profile, due to the circular nature of the profile nearer to the throat of the acoustic horn.

Figure 14A:
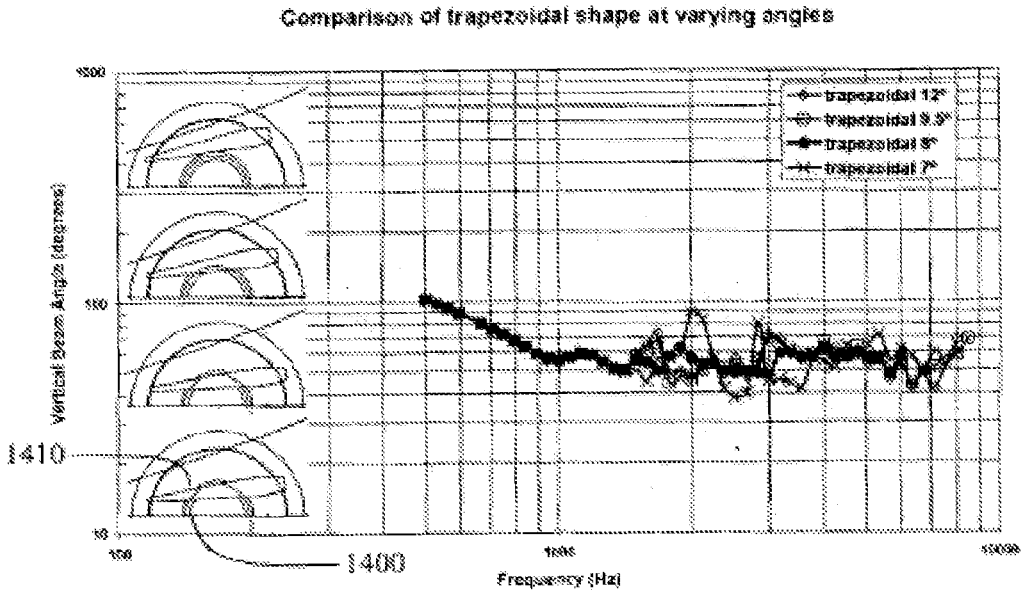
FIG. 14A is a graph of vertical beam angle as a function of frequency showing the variations in vertical beam angle when using a truncated kite aperture and changing the angle of orientation of the aperture with the centre line of the acoustic horn arrangement.
Figure 14B:
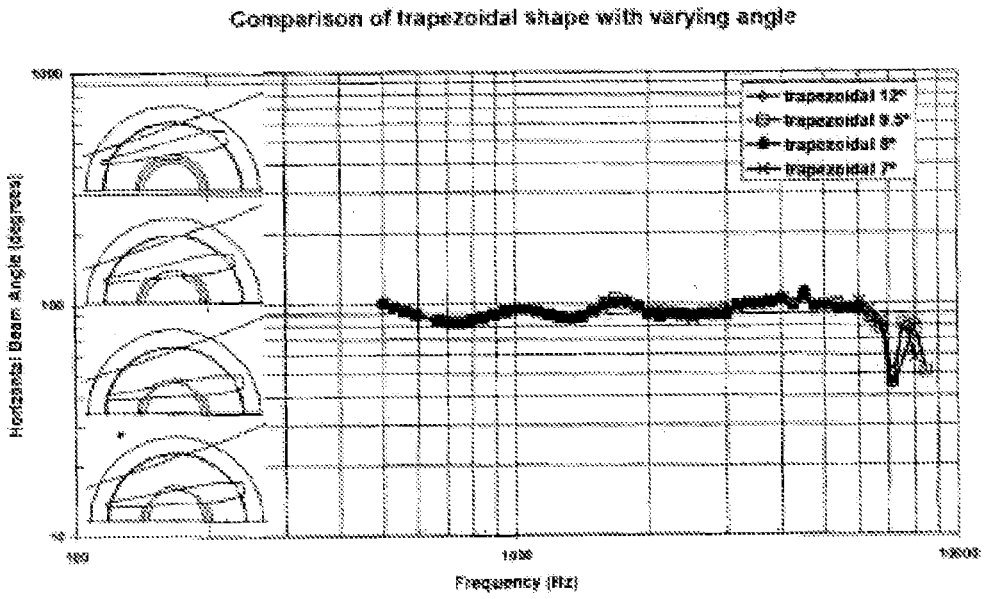
FIG. 14B graph of horizontal beam angle as a function of frequency corresponding to the arrangement illustrated in FIG. 14A.

FIG. 14A is a graph of vertical beam angle versus frequency, showing the variations in vertical beam angle when using a truncated kite shape aperture 1410 and using a smaller range of angles with respect to centreline 1400 than depicted in FIG. 13A. FIG. 14B shows the equivalent variation in horizontal beam angle for the truncated kite shape aperture depicted in FIG. 14A. As expected within this angle range, the beam angle performance and in particular the vertical beam angle performance improves generally with the angle of orientation even with this different shaped aperture.

The applicant has found through a combination of experimentation and simulation analysis that, the interface region of an acoustic horn arrangement where sound transfers from the second driver into the acoustic horn may be adapted to improve the uniformity of the beam angle performance and in particular the vertical beam angle performance. In one embodiment, this may achieved by reducing or substantially minimising the proportion of area of the aperture or apertures that lies on the centre line of the acoustic horn and that this functions to reduce the amount of wavefront distortion. In further analysis, the applicant has found that orienting the apertures so that they are generally parallel to or along the stream lines of the wave propagation (that is, at right angles to the wavefronts) of the sound from the first sound driver also functions to further reduce the wavefront distortion. Further analysis, has also found that shaping the apertures appropriately may also function further to reduce the wavefront distortion on the sound field.

An additional benefit of an acoustic horn arrangement in accordance with the present invention is that for a given beam angle performance the size of the apertures of the interface region may be increased as compared to prior art arrangements allowing more sound energy to enter the acoustic horn.

The illustrative embodiments and associated simulations discussed above are with respect to a constant directivity (CD) horn having an area of coverage of nominally 90°×50° (H×V) and with a generally rectangular cross-section. It would be readily appreciated that the present invention may be applied to acoustic horns of other geometries where the configuration of the horn defines vertical and horizontal directions with respect to the acoustic horn such as an acoustic horn having an elliptical profile or cross-section.

While in these illustrative embodiments, the sound from the first sound driver and the sound from the second sound driver are generated in different frequency ranges, equally they may be generated substantially in the same frequency range to provide an enhanced overlap region which gives increased flexibility in the choice of any crossover frequency within the enhanced overlap region.

As would be appreciated by those of ordinary skill in the art while the first to fifth embodiments have depicted pairs of apertures symmetrically disposed about the centreline of the acoustic horn, the number or configuration of apertures need not be limited to this arrangement but will be determined in accordance with the present invention by the characteristics of the relevant sound drivers and the acoustic horn.

Figure 15A:
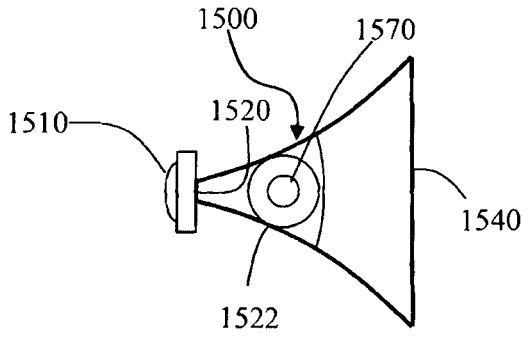
FIGS. 15A and 15B are side and top diagrams of an acoustic horn arrangement in accordance with an illustrative embodiment of the present invention involving the introduction of sound from two additional sound drivers.
Figure 15B:
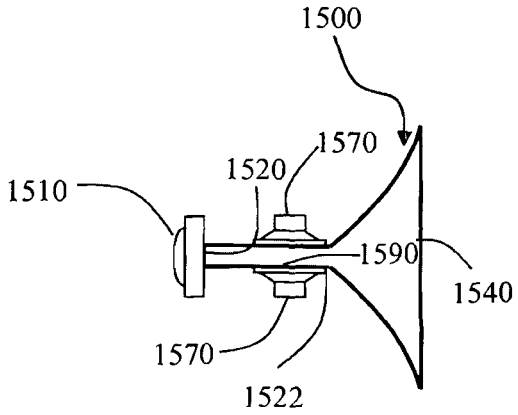

In the following FIGS. 15 to 17, there are shown a number of different arrangements incorporating two additional sound drivers. Referring now to FIGS. 15A and 15B there are shown side and top diagrams of an acoustic horn arrangement including an acoustic horn 1500 and having a throat 1520, mouth 1540 with a sound driver 1510 located at the throat 1520. In this acoustic horn arrangement, a further two sound drivers 1570 are mounted either side of the feeder section 1522 of acoustic horn 1500 with these portions of acoustic horn 1500 each having an interface region 1590 adapted in accordance with the present invention to allow sound from the sound drivers 1570 to enter the acoustic horn 1500.

The arrangement depicted in FIGS. 15A and 1513 is essentially equivalent to that depicted in the first to fifth illustrative embodiments except that instead of a single sound driver being mounted on one side of the feeder section 1522 of the acoustic horn 1500, there are now two opposed sound drivers as illustrated in FIG. 15B in addition to the primary driver 1510 located at the throat 1520 of acoustic horn 1500. The interface regions 1590 have been advantageously positioned on the side walls of feeder section 1522 of the acoustic horn 1500 allowing the further two sound drivers 1570 to be positioned closely against the side walls, thereby providing the shortest path for sound waves from the additional sound drivers 1570 to enter the acoustic horn 1500.

Figure 16A:
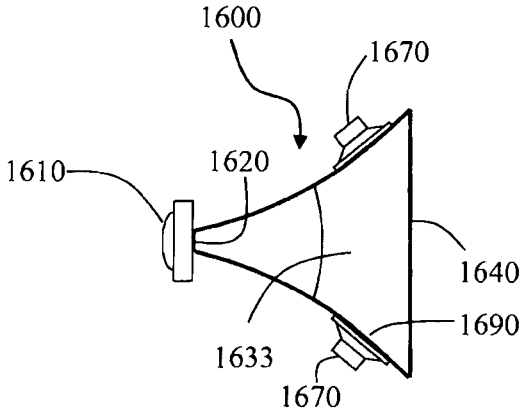
FIGS. 16A and 16B are side and top diagrams of an acoustic horn arrangement in accordance with a further illustrative embodiment of the present invention involving the introduction of sound from two additional sound drivers.
Figure 16B:
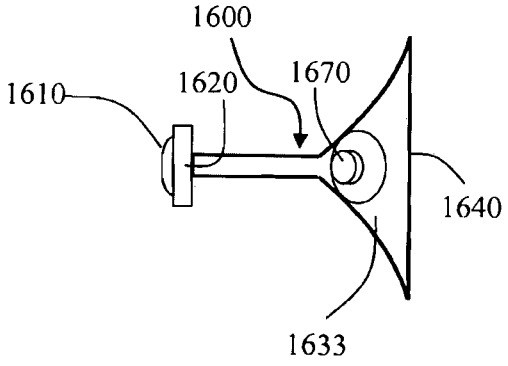

Referring now to FIGS. 16A and 16B there are shown side and top views of an acoustic horn arrangement including an acoustic horn 1600 having a throat 1620, mouth 1640 with a sound driver 1610 located at the throat 1620. In this acoustic horn arrangement, a further two sound drivers 1670 are mounted either side of the bell section 1633 of acoustic horn 1600 with these portions of acoustic horn 1600 each having an interface region 1690 adapted in accordance with the present invention to allow sound from the sound drivers 1670 to enter the acoustic horn 1600. This arrangement would typically be used when extremely high outputs at low frequencies are needed and the loudspeaker drivers needed to deliver this required output are too large to physically fit either side of the feeder section of the acoustic horn 1600 as shown in FIGS. 15A and 15B.

Figure 17A:
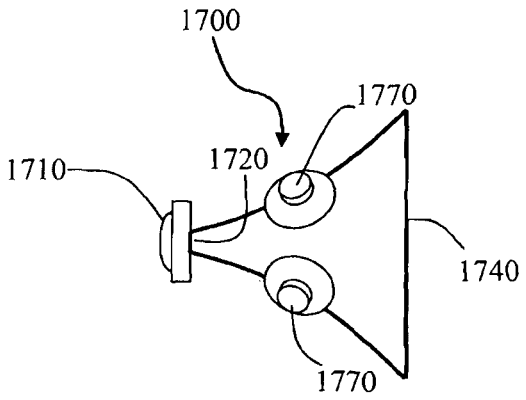
FIGS. 17A and 17B are side and top diagrams of an acoustic horn arrangement in accordance with a yet another illustrative embodiment of the present invention involving the introduction of sound from four additional sound drivers.
Figure 17B:
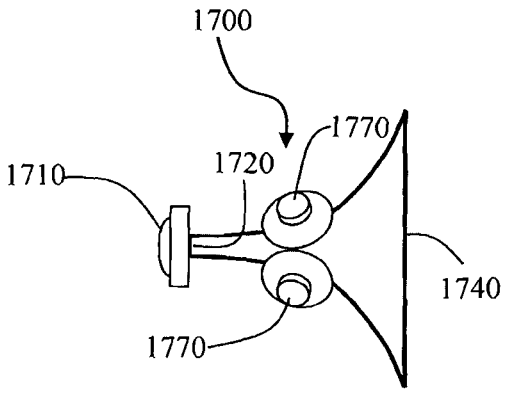

Referring now to FIGS. 17A and 17B there are shown side and top diagrams of an acoustic horn arrangement 1700 having a throat 1720, mouth 1740 with a sound driver 1710 located at the throat 1720. In this acoustic horn arrangement, a further four sound drivers 1770 are mounted in the transition region between the feeder and bell sections of the acoustic horn 1700 with these portions of acoustic horn 1700 each having an interface region 1790 adapted in accordance with the present invention to allow sound from the sound drivers to enter the acoustic horn 1700. This could be an alternative embodiment to that depicted in FIGS. 16A and 16B when very high sound outputs at low frequencies are needed.

Depending on the required performance characteristics of the acoustic horn arrangement, further sound drivers may be necessary and it will be appreciated that the present invention may be applied to those respective interface regions where sound from these additional drivers enters into the acoustic horn. While the additional sound drivers have been depicted as symmetrically arranged about the acoustic horn, it would be appreciated by those of ordinary skill in the art that this need not necessarily be the case and that individual sound drivers and associated interface regions may be arranged as required depending on the desired acoustic requirements of the horn arrangement.

In another illustrative embodiment, directed to horns for line array applications, the first sound source could be a high aspect ratio rectangular sound source sound driver. Further sound drivers may then be introduced into this arrangement employing interface regions in accordance with the principles of the present invention.

Simulations have also found that sound from the first or main sound driver also enters the apertures of the interface region causing frequency resonance effects that affect the frequency response of the acoustic horn from the first or main driver. The apertures and the volume of air immediately in front of the second sound driver form a cavity resonator, also called a Helmholtz resonator, which selectively absorbs sound energy from the first or main sound driver and causes variations in its on-axis frequency response.

Figure 18:
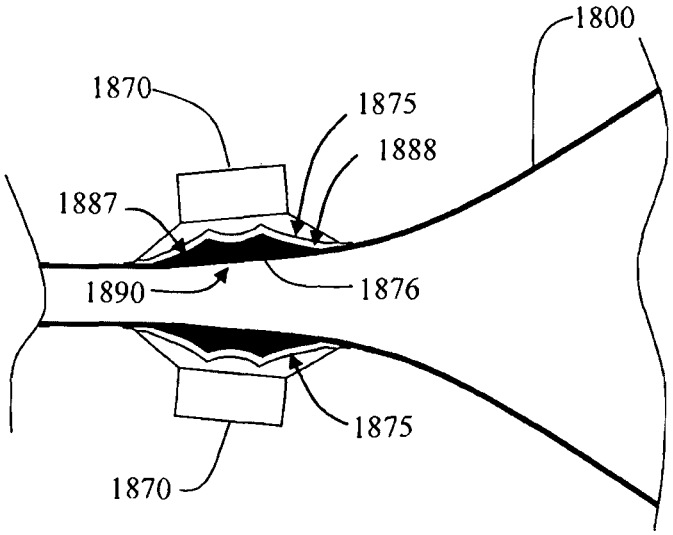
FIG. 18 is a side sectional diagram depicting an adapted interface region to modify the frequency response of the acoustic horn in accordance with an illustrative embodiment of the present invention.

Referring now to FIG. 18, there is shown a partial cross section diagram of an acoustic horn 1800, showing sound drivers 1870 in the form of loudspeakers having loudspeaker cones (diaphragm elements) 1875 mounted on each side of the acoustic horn 1800 similar to the arrangement depicted in FIGS. 15A and 15B. A cavity resonator is formed by the volume of air between the surface of the cone and the outside surface of the side of the horn, and the aperture. The resonant frequency can be altered by making the volume of the cavity large to place it below operating frequencies, or making the volume small to place it above operating frequencies. Accordingly, the layout of the cavity resonator may be adapted by the incorporation of a phase plug structure 1887 to modify the cavity resonant frequency and place it at a frequency where it has a minimal effect on the on-axis frequency response of the first sound driver (not shown).

In this illustrative embodiment, the interface region 1890 is further adapted by a phase plug member 1887 incorporating apertures 1876 connecting the air space immediately under the cone 1888 with the air in the acoustic horn 1800. In this manner, the apertures 1876 are usually extended to be as close to the loudspeaker cones 1875 as practical by the phase plug member 1887. In this manner, the phase plug member 1887 and the airspace immediately under the cone 1588 form an acoustic resonator wherein the configuration of the phase plug member 1887 may be adjusted to a suitable resonant frequency which has minimal effect on the propagation of sound from the first or main driver down the horn 1800 and to the environment.

There also exists a second resonance in this arrangement, that of the volume of the cavity immediately under the cone 1888 and the moving mass of the cone 1875. This resonance may also affect the frequency response of the additional sound drivers 1870. This resonance is known to those skilled in the art of compression driver design, and can be used to augment and extend the frequency response of the second sound driver. In this embodiment, the placement of this second resonant frequency is determined by the volume of air 1888 immediately in front of the diaphragm 1875. This volume has a minimum set by its depth which has to allow maximum excursion of the loudspeaker diaphragm 1875. A slightly larger depth could be used to place the phase plug member 1887 and cavity resonant frequency to have minimal effect on the frequency response of the first or main driver.

The chosen dimensions of aperture opening, length of phase plug member, and the volume of the cavity is an engineering decision to obtain the optimum performance from the, main or high frequency sound driver and the side or low frequency sound drivers. In outline, a suitable loudspeaker driver is chosen for the second sound driver, a suitable compression ratio is chosen for its operation, which then fixes the area of the aperture. The physical diameter of the loudspeaker determines how closely it can be placed to the feeder section of the main horn, and additionally the geometry or shape of the loudspeaker cone determines the length of the phase plug passages. Once the apertures have been positioned at the optimum angle in the main horn to obtain a good beam angle performance, the path lengths of the phase plug are fixed and hence one component of the secondary resonant system is fixed.

The other component of the secondary resonant system is the volume of air immediately underneath the cone, and the volume chosen is a compromise between the resonant frequency as seen by the main horn, the resonant frequency as seen by the mass of the second sound driver, and the requirement to obtain clearance for the second sound driver to exert its maximum excursion or displacement.

It will be understood that the term "comprise" and any of its derivatives (eg. comprises, comprising) as used in this specification is to be taken to be inclusive of features to which it refers, and is not meant to exclude the presence of any additional features unless otherwise stated or implied.

The reference to any prior art in this specification is not, and should not be taken as, an acknowledgement of any form of suggestion that such prior art forms part of the common general knowledge.

Although illustrative embodiments of the present invention have been described in the foregoing detailed description, it will be understood that the invention is not limited to the embodiment disclosed, but is capable of numerous rearrangements, modifications and substitutions without departing from the scope of the invention as set forth and defined by the following claims.

The invention claimed is:

1. An acoustic horn arrangement including:

an acoustic horn, the acoustic horn including a throat entrance and a mouth exit and further including an outwardly flaring wall region extending from the throat entrance to the mouth exit;

a first sound driver operable to drive the acoustic horn, the first sound driver located at the throat entrance of the acoustic horn;

a second sound driver further operable to drive the acoustic horn; and an interface region located in the wall region of the acoustic horn where sound from the second sound driver transfers into the acoustic horn to combine with sound from the first sound driver, wherein the interface region includes at least one aperture that is elongate generally in a direction of sound propagating down the acoustic horn and wherein the at least one elongate aperture is located to substantially minimise a proportion of area of the at least one elongate aperture that lies on a centre line of the acoustic horn to reduce changes in a beam angle measure of the acoustic horn as a function of frequency.

2. An acoustic horn arrangement as claimed in claim 1, wherein the sound from the first sound driver is generated in a first frequency range and the sound from the second sound driver is generated in a second frequency range.

3. An acoustic horn arrangement as claimed in claim 1, wherein the acoustic horn arrangement has constant directivity characteristics.

4. An acoustic horn arrangement as claimed in claim 1, wherein the configuration of the acoustic horn arrangement defines vertical and horizontal directions with respect to the acoustic horn and wherein the interface region is adapted to reduce changes in the vertical beam angle of the acoustic horn as a function of frequency.

5. An acoustic horn arrangement as claimed in claim 1, wherein the at least one elongate aperture is oriented to follow a streamline of the sound from the first sound driver.

6. An acoustic horn arrangement as claimed in claim 1, wherein the at least one elongate aperture has a rectangular slit configuration.

7. An acoustic horn arrangement as claimed in claim 1, wherein the at least one elongate aperture has a tapered or wedge shape slit configuration.

8. An acoustic horn arrangement as claimed in claim 7, wherein a width of the tapered or wedge shape slit configuration is held to be a substantially constant fraction of a dimensional characteristic of the acoustic horn.

9. An acoustic horn arrangement as claimed in claim 8, wherein the dimensional characteristic is the circumference of the acoustic horn.

10. An acoustic horn arrangement as claimed in claim 8, wherein the dimensional characteristic is the cross sectional area of the acoustic horn.

11. An acoustic horn arrangement as claimed in claim 1, wherein the at least one elongate aperture has a kite shaped configuration.

12. An acoustic horn arrangement as claimed in claim 1, wherein the at least one elongate aperture has a truncated kite shape configuration.

13. An acoustic horn arrangement as claimed in claim 1, wherein the acoustic horn has a rectangular cross-section.

14. An acoustic horn arrangement as claimed in claim 1, wherein the acoustic horn has an elliptical cross-section.

15. An acoustic horn arrangement as claimed in claim 1, wherein the interface region is further adapted to modify a cavity resonance frequency caused by a cavity formed between the interface region and the second sound driver to substantially minimise the effect of the cavity resonant frequency on the on-axis frequency response of the first sound driver.

16. An acoustic horn arrangement as claimed in claim 15, wherein the interface region is adapted to modify the cavity resonance frequency by a phase plug member incorporating apertures connecting the air space of the second sound driver to the air in the acoustic horn.

17. An acoustic horn arrangement including an acoustic horn operable to be driven by a first sound driver, the acoustic horn arrangement further including two or more additional sound drivers each introducing sound into the acoustic horn by a respective interface region, located in the wall region of the acoustic horn, wherein the respective interface region for each of the two or more additional sound drivers is adapted to reduce changes in the beam angle of the acoustic horn as a function of frequency in accordance with claim 1.

18. A sound reproduction system including the acoustic horn arrangement of claim 1.

19. An interface arrangement for transferring sound from a secondary sound driver having a loudspeaker cone into an acoustic horn driven by a first sound driver located at a throat entrance of the acoustic horn, the interface arrangement including a phase plug member to define the path length and volume of air of a cavity formed between a surface of the loudspeaker cone of the secondary sound driver and an interface region, located in an outwardly flaring wall region of the acoustic horn, wherein the phase plug member incorporates apertures that extend close to the surface of the loudspeaker cone to connect the air space immediately under the loudspeaker cone with the air in the acoustic horn to form an acoustic resonator and modify the cavity resonant frequency to substantially minimise the effect of the cavity on the on-axis frequency response of the first sound driver.

* * * * *